US009969945B2

(12) United States Patent
Ancheyta Juarez et al.

(10) Patent No.: US 9,969,945 B2
(45) Date of Patent: May 15, 2018

(54) PROCESS FOR PARTIAL UPGRADING OF HEAVY AND/OR EXTRA-HEAVY CRUDE OILS FOR TRANSPORTATION

(71) Applicant: INSTITUTO MEXICANO DEL PETROLEO, Mexico City (MX)

(72) Inventors: Jorge Ancheyta Juarez, Mexico City (MX); Luis Carlos Castaneda Lopez, Mexico City (MX); Jose Antonio D. Munoz Moya, Mexico City (MX); Guillermo Centeno Nolasco, Mexico City (MX); Gustavo Jesus Marroquin Sanchez, Mexico City (MX); Sergio Ramirez Amador, Mexico City (MX); Fernando Alonso Martinez, Mexico City (MX)

(73) Assignee: Instituto Mexicano Del Petroleo, Mexico City (MX)

( * ) Notice: Subject to any disclaimer, the term of this patent is extended or adjusted under 35 U.S.C. 154(b) by 201 days.

(21) Appl. No.: 14/799,801

(22) Filed: Jul. 15, 2015

(65) Prior Publication Data

US 2016/0060549 A1 Mar. 3, 2016

(30) Foreign Application Priority Data

Aug. 27, 2014 (MX) ..... MX/A/2014/010277

(51) Int. Cl.
*C10G 67/00* (2006.01)
*C10G 65/00* (2006.01)
(Continued)

(52) U.S. Cl.
CPC ..... *C10G 67/00* (2013.01); *C10G 5/06* (2013.01); *C10G 7/02* (2013.01); *C10G 45/04* (2013.01);
(Continued)

(58) Field of Classification Search
CPC ..... C10G 67/00; C10G 45/64; C10G 45/04; C10G 45/06; C10G 45/08; C10G 45/10;
(Continued)

(56) References Cited

U.S. PATENT DOCUMENTS 5,080,779 A * 1/1992 Awbrey ..... C10G 17/02 208/251 R
6,355,159 B1 3/2002 Myers et al.
(Continued)

*Primary Examiner* — Randy Boyer
*Assistant Examiner* — Juan C Valencia
(74) *Attorney, Agent, or Firm* — Dickinson Wright, PLLC

(57) ABSTRACT

The present invention relates to a process for the partial upgrading of properties of heavy and/or extra-heavy crude oil by low severity catalytic hydrotreatment in only one reaction step. The process of the present invention is obtained upgraded oil with properties required for its transportation from offshore platforms either to maritime terminal or to refining centers. The process reduces the viscosity of heavy and/or extra-heavy crude oil, and decreases the concentration of impurities, such as sulfur, nitrogen, and metals, in such a way that heavy and/or extra-heavy crude oils can be transported to maritime terminals or to refining centers. The process increases the lifetime of the catalyst and decreased operating costs by reducing consumption of utilities because the operation of the process is carried out at lower severity. The partially upgraded oils obtained in this process can be transported directly to the maritime terminals or to existing refineries.

17 Claims, 1 Drawing Sheet

(51) Int. Cl.

| | |
|---|---|
| ***C10G 45/04*** | (2006.01) |
| ***C10G 45/06*** | (2006.01) |
| ***C10G 45/08*** | (2006.01) |
| ***C10G 45/10*** | (2006.01) |
| ***C10G 45/60*** | (2006.01) |
| ***C10G 45/62*** | (2006.01) |
| ***C10G 45/64*** | (2006.01) |
| ***C10G 47/04*** | (2006.01) |
| ***C10G 47/06*** | (2006.01) |
| ***C10G 5/06*** | (2006.01) |
| ***C10G 7/02*** | (2006.01) |

(52) U.S. Cl.
CPC ..... *C10G 45/06* (2013.01); *C10G 45/08* (2013.01); *C10G 45/10* (2013.01); *C10G 45/60* (2013.01); *C10G 45/62* (2013.01); *C10G 45/64* (2013.01); *C10G 47/04* (2013.01); *C10G 47/06* (2013.01); *C10G 65/00* (2013.01); *C10G 2300/1033* (2013.01); *C10G 2300/202* (2013.01); *C10G 2300/302* (2013.01)

(58) Field of Classification Search
CPC ..... C10G 45/60; C10G 45/62; C10G 7/02; C10G 47/04; C10G 47/06; C10G 5/06; C10G 65/00; C10G 2300/302; C10G 2300/1033
See application file for complete search history.

(56) References Cited

U.S. PATENT DOCUMENTS

| | | | | |
|---|---|---|---|---|
| 7,381,320 | B2 | 6/2008 | Iqbal et al. | |
| 2007/0267327 | A1 | 11/2007 | Boakye | |
| 2008/0083653 | A1 | 4/2008 | Bruha | |
| 2013/0056394 | A1* | 3/2013 | Ancheyta Juarez | C10G 67/00 208/80 |

* cited by examiner

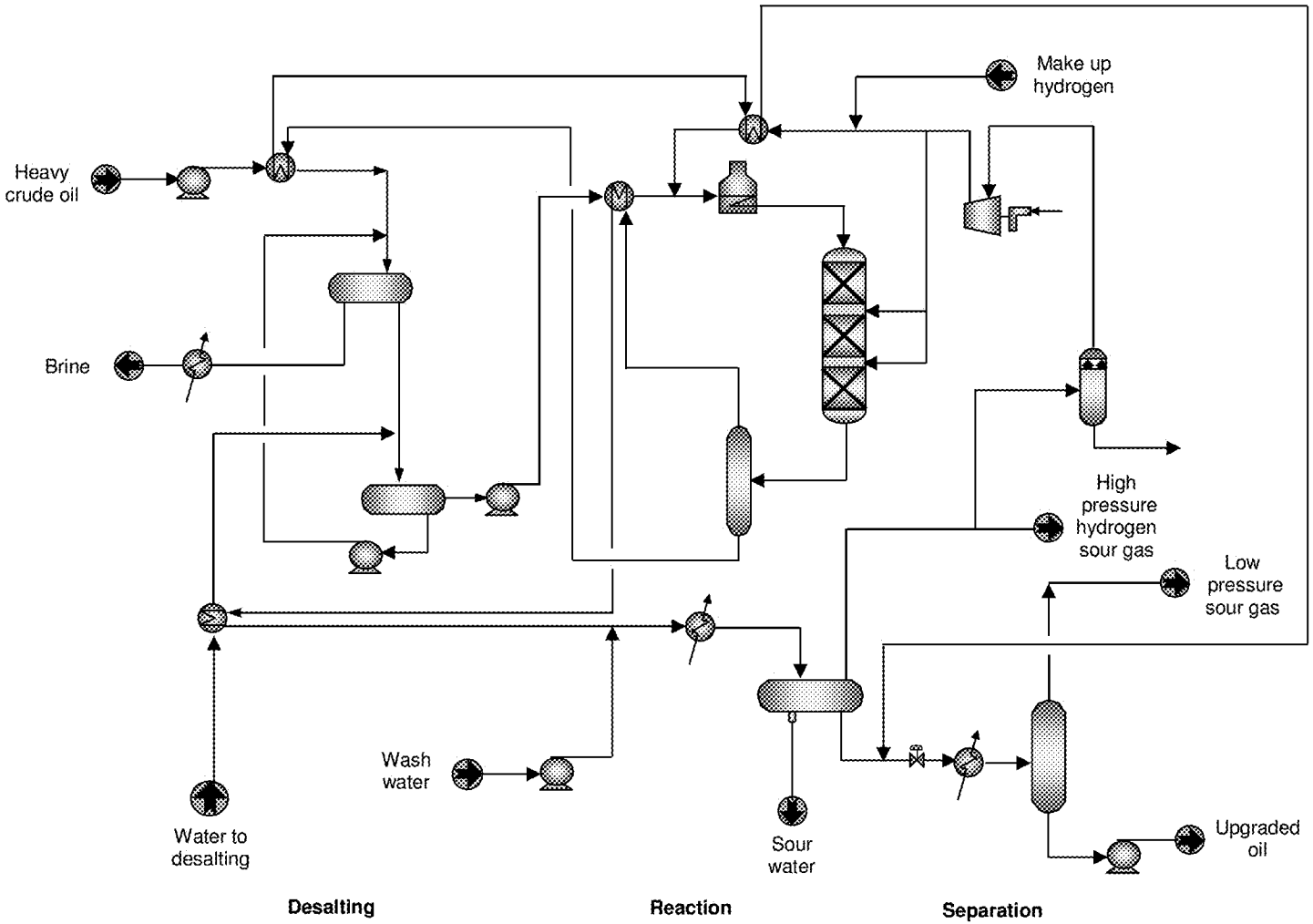
Make up hydrogen
High pressure hydrogen sour gas
Low pressure sour gas
Upgraded oil
Separation
Sour water
Reaction
Wash water
Desalting
Water to desalting
Heavy crude oil
Brine

PROCESS FOR PARTIAL UPGRADING OF HEAVY AND/OR EXTRA-HEAVY CRUDE OILS FOR TRANSPORTATION

CROSS-REFERENCE TO RELATED APPLICATION

This application claims the benefit and priority under 35 U.S.C. § 119 to Mexican Patent Application No. MX/a/2014/010277 with a filing date of Aug. 27, 2014, the disclosure of which is incorporated herein by reference in its entirety.

FIELD OF THE INVENTION

The present invention relates to a process for the partial upgrading of properties of heavy and/or extra-heavy crude oils, primarily for the transportation of crude oil, by catalytic hydrotreatment in one reaction step at low severity operating conditions.

It is important to point out that, by means of the process of the present invention, partial upgraded oil is obtained with properties required for its transportation from platform either to maritime terminals or to centers where these crude oils can be processed.

BACKGROUND OF THE INVENTION

The American Petroleum Institute classifies crude oils as "light", "medium", "heavy", and "extra-heavy", according to their API gravity:

Light crude oil: has API gravity greater than 31.1° API;

Medium crude oil: has API gravity between 22.3 and 31.1° API;

Heavy crude oil: has API gravity between 10 and 22.3° API; and

Extra-heavy crude oil: has API gravity lower than 10° API.

The depletion of light and medium crude oil reserves has forced the production and refining of increasingly heavier crude oil. Among other economic and technological types of implications, this problem has grown making it progressively difficult not only for the extraction of this crude oil but its transportation from platforms to maritime terminals or to existing refineries, since a crude oil is considered transportable as long as it meets the required specifications of API gravity and viscosity essentially.

Hence, platforms and maritime receiving and distributing terminals of crude oil will be in the need for applying efficient and affordable technologies of heavy crude oil upgrading to accomplish the demands of current and future refineries.

Nowadays, various process technologies for upgrading of heavy crude oils and residues are available to overcome their transportation problems. However, most of these technologies are inappropriate to be installed on platforms that require a lot of space, therefore a conscious evaluation must be applied to fulfill important criteria such as: investment, adaptation of compact versions for platforms and maritime terminals, capacity, feedstock, byproducts disposal, etc.

Current technologies for upgrading heavy crude oils and residues such as delayed coking, catalytic cracking of residue, solvent deasphalting, catalytic hydrocracking, among others, are mainly designed to operate at reaction conditions, reactor configuration, type of reaction system, catalysts, etc. such as to obtain the maximum conversion and required quality of products, so that their application to operate at low severity conditions are inefficient, impractical and uneconomical.

The state-of-the-art related to the present invention, by referring to the use of processes for partial upgrading of the properties of the heavy and extra-heavy crude oils, is here represented by the following patent documents:

U.S. Pat. No. 7,381,320, issued on Jun. 3, 2008, relates to a process of upgrading and demetallizing heavy crude oils and bitumen. The process involves mainly the following stages: (1) Feedstock is supplied to a solvent extraction process to separate asphaltenes, and obtain a deasphalted oil with reduced content of metals, (2) The deasphalted oil is processed in a fluid catalytic cracking unit (FCC) with a catalyst of low activity for the removal of metals, (3) The demetallized fraction is hydrotreated to improve the properties and obtain a synthetic crude oil. Hydrotreating is carried out at pressure of 35 kg/cm$^2$ to 105 kg/cm$^2$ and 350-400° C., (4) The fraction containing asphaltenes can be sent to a gasification process for generating power, steam and hydrogen, which can be used in the hydrotreating process, (5) The excess of asphaltenes and/or decanted oil can be processed in a coker unit for producing naphtha, middle distillates and gasoil, which can be sent to hydrotreating units.

U.S. Patent Publication No. 2008/0083653, published on Apr. 10, 2008, relates to a process of partial upgrading of heavy crude oil, which is processed first in a solvent deasphalting unit, where two fractions are obtained, a free of asphaltenes light fraction and a heavy fraction concentrated in asphaltenes.

The deasphalted fraction is processed in a fluid catalytic cracking unit loaded with a catalyst of low activity and low conversion, to produce a light distillate fraction of a hydrocarbon (generally naphtha) that can be used as a diluent for the end users. The intermediate fractions can be sent to a hydrotreating unit to be further combined with the produced diluent to form synthetic crude oil that can be delivered to a refinery. The heavy fraction can be processed in a gasifier that allows for the generation of electricity, steam and hydrogen.

U.S. Patent Publication No. 2007/0267327, published on Nov. 22, 2007, relates to a process for upgrading of heavy crude oil to synthetic crude oil with acceptable properties as refinery feedstock. The method includes solvent deasphalting for separating asphaltene fraction of heavy oil and contacting the deasphalted oil with biological and chemical reagents to reduce pollutant concentrations through oxidation. The recommended solvent for the deasphalting process is composed of a mixture of paraffinic, iso-paraffinic and aromatic hydrocarbons ranging from $C_4$ to $C_{10}$. Then the deasphalted oil is submitted to biochemical oxidation to remove nickel, vanadium, sulfur, nitrogen and unsaturated compounds present in high concentrations in the heavy oil.

U.S. Pat. No. 6,355,159, issued on Mar. 12, 2002, relates to a moderate hydroconversion of heavy crude oil followed by addition of a specific diluent to stabilize the synthetic crude oil against phase separation and asphaltenes. In this process, a product with lower viscosity and API gravity suitable for pipeline transportation is obtained. The product needs to be stabilized, because the hydrotreating alters the solubility of asphaltenes, which can be separated into pipelines during transportation or when the product comes into contact with other oils. As mild hydroconversion it relates to a catalytic process in the presence of hydrogen, in which around 40-60% of the 525° C. fraction of the heavy oil is converted to lower viscosity oil. The hydroconversion is carried out at temperatures ranging between 400-450° C. and pressures ranging from 49-105 kg/cm$^2$ for sufficient time to reduce the viscosity of the oil.

SUMMARY OF THE INVENTION

The disadvantages of the technologies mentioned in the above patents are overcome by the present invention, as the prior processes relate to upgrading processes of crude oil in at least two steps for obtaining upgraded oil or processes operating at high severity conditions. However, the prior processes neither indicate nor suggest hydrotreating of heavy and/or extra-heavy crude oil, in a single stage at low severity conditions.

For purposes of the present invention, it is stated that the term "operating conditions of low severity" will be used when referring to processes for crude oil hydrotreating operating at maximum temperatures of 400° C. and maximum pressures of 100 kg/cm$^2$.

The extra heavy crude oil has an API gravity of 10° API or less. The heavy crude oil of the invention has an API gravity of 10-22.3° API.

It is therefore an object of the present invention to provide a process comprising the catalytic hydrotreating of heavy and/or extra-heavy crude oil having 3-16° API, in a single reaction step at operating conditions of low severity, to produce upgraded oil with suitable properties for its transportation. The upgraded oil refers to a hydrotreated crude oil having a reduced viscosity relative to the viscosity of the heavy and/or extra heavy crude oil feed and a reduced concentration of impurities, such as sulfur, nitrogen and metal compounds. The upgraded crude oil also has an increased API gravity of about 4 to 8 degrees relative to the original heavy and/or extra heavy crude feed.

An additional object of the present invention is to provide a process for obtaining partial upgraded oil with the properties required for transportation either from offshore platforms to the maritime terminals or to refining centers. The process of the invention increases the API gravity and reduces the viscosity to a level typical of light and medium crude oil.

The features of the invention are basically attained by providing a process of upgrading heavy and/or extra heavy crude oil to reduce the viscosity of the crude oil to improve the handling, transportation and further processing of the crude oil. The process of the invention includes the steps of desalting the heavy and/or extra heavy crude oil by a desalting device, such as two desalters connected in series, catalytic hydrotreating the desalted heavy and/or extra heavy crude oil at a maximum temperature of 400° C. and pressure of 100 kg/cm$^2$ in a single reaction step to obtain a partially upgraded crude oil, and thereafter separating and recovering the partially upgraded crude oil. The upgraded oil has better quality for transportation from platforms to maritime terminals or to refining centers.

The process of the invention subjects the heavy and/or extra heavy crude oil to a catalytic hydrotreatment to reduce the kinematic viscosity and increase the API gravity to a level where the treated crude oil can be more easily transported through pipes or other means to maritime terminals or refining centers. In one embodiment, the catalytic hydrotreatment reduces the kinematic viscosity at 37° C. to 230 cSt or below to resemble the kinematic viscosity of medium crude oil. In another embodiment the API gravity is increased at least 4 degrees, and preferably at least 6 degrees relative to the crude oil feed. The API gravity can be increased about 4 to 8 degrees relative to heavy and/or extra heavy crude oil feed.

The features of the invention are further attained by providing a method of transporting heavy and/or extra heavy crude oil by catalytic hydrotreament of a desalted heavy and/or extra heavy crude oil at a temperature of not higher than 400° C. and a pressure of not higher than 100 kg/cm$^2$ in a single reaction step to obtain a partially upgraded crude oil, recovering the partially upgraded crude oil and transporting the partially upgraded crude oil through a pipeline.

BRIEF DESCRIPTION OF THE DRAWINGS

FIG. 1 shows a process flow diagram of the present invention, related to partial upgrading of the properties of heavy and/or extra-heavy crude oils, mainly for transportation; by the catalytic hydrotreatment in one reaction step and operating conditions of low severity.

DETAILED DESCRIPTION OF THE INVENTION

The present invention relates to a process for the partial upgrading of heavy and/or extra-heavy crude oil properties, mainly for its transportation, by catalytic hydrotreatment in one reaction step at operating conditions of low severity. The upgrading of the crude oil reduces the level of impurities, such as sulfur, nitrogen and metal compounds. The partial upgrading treats the heavy and extra heavy crude oil to obtain a crude oil with reduced viscosity to be more amenable to transporting through pipelines and processing facilities.

For purposes of the present invention, the term "operating conditions of low severity" will be used when referring to processes for crude oil hydrotreating operating at maximum temperatures of 400° C. and pressures of 100 kg/cm$^2$ or less.

In this regard, it is important to note that by the process of the present invention produces upgraded oils with properties required for transportation from the platforms either to the maritime terminals or to refining centers. The upgraded crude oil preferably has a kinematic viscosity of 230 cSt or less at 37.8° C. and an increased API of 4 to 8 degrees.

The process of the present invention hydrotreats heavy and/or extra-heavy crude oils with API gravity ranging from 3 to 16 units in one reaction step at operating conditions of low severity, mainly for partial upgrading of the properties for their transportation. The upgrading of the crude oil increases the API about 4 to 6 degrees and decreases the viscosity to improve handling and transporting of the crude oil.

FIG. 1 shows a flowchart of the process of the present invention, which comprises three stages:

1) Desalting of heavy or extra-heavy crude oil;
2) Catalytic hydrotreating of heavy and/or extra-heavy desalted crude oil
3) Separation of partially upgraded oil.

Step 1) Desalting of heavy and/or extra-heavy crude oil, preferably comprises an array of two desalination plants, preferably the dielectric type, connected in series for crude oil containing below 200 PTB (Pounds Thousand Barrels, i.e. pounds per 1,000 barrels) of salt to meet the specification of the crude oil fed to the reactor. The salt removal is carried out under pressure of 7 to 14 kg/cm$^2$ and temperature from 125 to 150° C., where the pressure is preferably at least 2 kg/cm$^2$ above the vapor pressure of the oil-water mixture operating temperature.

Step 2) Catalytic hydrotreating of heavy and/or extra-heavy uses the desalted crude oil from step 1), which is neither further separated nor further conditioned in any way, as performed in current refineries, according to the prior art reported in the background of the invention. Step 2) is conducted under operating conditions of low severity and is performed in a conventional size plant or a plant built with compact equipment without affecting the properties of partial upgraded oil required for its transportation.

The catalytic hydrotreatment of heavy and/or extra heavy desalted crude oil is performed at low severity operation conditions in one reaction step, preferably using a fixed-bed reactor with a catalyst containing metals, such as Pt, Pd, Ni, Mo and Co, preferably Ni, Mo and Co, more preferably nickel-molybdenum (Ni—Mo) mixtures or cobalt-molybdenum (Co—Mo) mixtures supported on aluminum oxide (alumina), silicon, titanium and mixtures thereof. In one embodiment, the catalyst support is preferably aluminum oxide in the gamma alumina phase.

One of the properties of the catalyst of the present invention is the hydrogenating function; i.e. the catalyst partially hydrogenates the molecules of heavier compounds, and a hydrocracking capacity, allowing selectively breaking reactions of heavy hydrocarbons. This is achieved with catalysts containing metals such as Pt, Pd, Ni, Mo and Co, etc., preferably Ni, Mo and Co, for its resistance to sulfur poisoning that have the property of chemisorbing hydrogen atoms.

Another important function of the catalyst bed is to retain heavy metals contained in heavy and/or extra-heavy crude oil, mainly, Ni, V, Fe, Cu and Pb. Thus a carrier with high porosity is selected such as aluminum oxides (alumina), silicon, titanium and mixtures thereof, these supports should also have adequate mechanical properties for operation in reactors at elevated pressures and temperatures, and textural properties to guarantee a suitable lifetime. In one embodiment, the catalyst carrier has a surface area of 180 to 200 m$^2$/g, pore volume of 0.7 to 0.8 cm$^3$/g and a particle size to avoid high pressure drops. The most appropriate catalysts for the process of the present invention use aluminum oxide in its gamma-alumina phase as a catalyst support. Different profiles of shape can be used to produce the active catalysts such as cylindrical extrudates, lobular or spheres ranging from 1 to 3 millimeters in diameter.

An additional function of the catalyst utilized in the process of the present invention is to convert in a controlled manner the sulfur and nitrogen compounds of the feed to hydrogen sulfide and ammonia, respectively. By selecting the combination of the type of reactor, type of catalyst and operating conditions of low severity, the reaction is oriented towards the hydrocracking of large molecules and the selectivity to the removal or reduction of impurities, allowing the process of the present invention to the exclusion of additional steps for the purification of sour gas produced and sulfur recovery.

The catalyst employed in the present invention preferably has low metal loading. In one embodiment the catalyst has a content of molybdenum from 2 to 8 weight %, and nickel or cobalt from 0.1 to 3 weight % in the fresh catalyst, supported on gamma alumina, with textural properties to ensure adequate life. The catalyst and catalyst support has a surface area of 180-200 m$^2$/g and pore volume of 0.7 to 0.8 cm$^3$/g. Different profiles of shape can be used to produce the active catalysts such as cylindrical extrudates, lobular or spheres from 1 to 3 millimeters in diameter.

The catalyst is loaded into the reactor using the procedures industrially applicable, in addition to the catalytic bed relaxers of pressure drop must be loaded, which may or may not have catalytic activity in hydrogenation, hydrocracking or both. Relaxer materials may also have different shapes, such as spheres, tablets, raschig and similar rings.

The operating conditions of the reaction zone for the catalytic hydrotreatment are: maximum pressure of 100 kg/cm$^2$, hydrogen to hydrocarbon ratio of 2,000 to 5,000 ft$^3$/bbl, temperature of 360 to 400° C. and space velocity or volumetric flow relative to volume of catalyst (LHSV: liquid hourly space velocity) of 0.25 to 3 h$^{-1}$. The rest of the operating conditions of the other equipment of the catalytic hydrotreating plant are similar to conventional units. Depending on the quality of the feedstock, it is possible to combine the different values of operating variables to obtain a partially upgraded oil with properties suitable for its transportation.

In summary, step 2) catalytic hydrotreatment of heavy and/or extra-heavy desalted crude oil, is designed to meet several objectives, namely:

- Reduce the kinematic viscosity of the feedstock to values below 250 cSt measured at 37.8° C.,
- Increase API gravity at value greater than 16 units, and
- Reduce the content of impurities, mainly organometallic compounds of sulfur and nitrogen. In one embodiment, up to 66% of the metal (Ni+V) is removed with a global deposit rate equal to 0.0168 weight % per hour equivalent to a catalyst life of 10 months. In another embodiment, up to 63% of sulfur is removed from the partially upgraded oil.

Step 3) Separation of partially upgraded oil, which is essential to remove the sour gases produced in the hydrotreated oil, comprises a high pressure and high temperature separator where the reaction product, which is a liquid vapor mixture, is fed directly to obtain gas through the top and liquid through the bottom. These two streams have high energy potential which is used to heat cold process streams through an energy integration. The gas stream exchanges heat with the flow of crude oil being fed to the reactor and the flow of desalinated water, reaching a temperature above 200° C. Wash water is added to solubilize the ammonium salts formed by nitrogen removal from crude oil, the mixture finally reaches the high pressure and low temperature separator tank where three streams are obtained: a gas stream corresponding to hydrogen of recirculation, the hydrocarbon liquid condensate phase, and sour water. A fraction of gas stream (3 to 8 volume %) is purged to avoid concentration of light hydrocarbons and hydrogen sulfide in the reaction circuit. This purge is a hydrogen-rich sour stream, the remaining fraction is sent to hydrogen compressor where the recirculation pressure for recycling to the reactor increases. Finally this stream together with make-up hydrogen stream is heated to complete the hydrogen circuit. The liquid stream, product of reactor exchanges heat with the feedstock and the hydrogen streams and is joined with the product hydrocarbon stream of the high pressure and low temperature separator, finally both hydrocarbons streams go to low pressure and low temperature separator where a sour gas stream and the partially upgraded oil are obtained.

Among the main technical contributions of the process of the present invention, compared with conventional processes are the following:

- It increases the API gravity, decreases the viscosity of heavy and/or extra-heavy crude oil, and reduces in a controlled manner the concentration of impurities such as sulfur, nitrogen, and metals in such a way that the heavy and/or extra-heavy crude oil can be transported to maritime terminals or to refining centers.
- The operation of the process at low severity conditions causes the catalyst to have long life thus reducing investment costs by diminishing the consumption of utilities.
- The obtained upgraded oils can be stored or transported directly to maritime terminals or to existing refineries, because their transport properties such as viscosity and API gravity are similar to those of light and medium crude oils usually processed.
- The combination of the type of reactor, type of catalyst and low severity conditions make the reactions to be oriented towards the hydrocracking, thus decreasing the selectivity to the removal of impurities, therefore the production of by-products is controlled, such as hydrogen sulfide, and the sweetening of produced gases is avoided, making the process more compact and simple.

EXAMPLES

To better illustrate the process of the present invention, below are some examples, which do not limit the scope of what is claimed herein.

Example 1

A heavy crude oil with 12.70° API and other properties presented in Table 1, was subjected to step 1) Desalting of heavy or extra-heavy crude oil of the present invention, to obtain a desalted crude oil with salt content lower than 1 ppm, with the same properties reported in Table 1.

The desalted crude oil was subjected to stage 2) Catalytic hydrotreating of heavy and/or extra-heavy desalted crude oil of the present invention, using a single fixed-bed reactor at operating conditions given in Table 2.

TABLE 1

Properties of heavy crude oil used as feedstock in all examples of the present invention.

| Properties | Value |
|---|---|
| Specific gravity 60/60° F. | 0.9813 |
| Specific weight 20/4° C. | 0.9785 |
| API Gravity | 12.70 |
| Kinematic viscosity, cSt @: | |
| 25.0° C. | 17547 |
| 37.8° C. | 4623 |
| 54.4° C. | 1226 |
| TBP Distillation, ° C. | |
| IBP/5 vol % | 36/135 |
| 10/20 vol % | 193/290 |
| 30/40 vol % | 382/461 |
| 50/60 vol % | 535/— |
| 70/80 vol % | —/— |
| Conradson carbon, weight % | 18.48 |

TABLE 1-continued

Properties of heavy crude oil used as feedstock in all examples of the present invention.

| Properties | Value |
|---|---|
| Sulfur, weight % | 5.25 |
| Total acid number (TAN), mg KOH/g | 0.36 |
| n-heptane-insolubles, weight % | 17.34 |
| Toluene-insolubles, weight % | 0.30 |
| Metals, wppm | |
| Nickel | 85.59 |
| Vanadium | 456.23 |
| Ni + V | 541.82 |

IBP: Initial Boiling Point;

TBP: True Boiling Point

TABLE 2

Operating conditions of step 2) Catalytic hydrotreating of the desalted heavy and/or extra-heavy desalted crude oil, of the present invention, Example 1.

| Variable | Condition |
|---|---|
| Pressure, $kg/cm^2$ | 50 |
| Temperature, ° C. | 385 |
| Space velocity (LHSV), $h^{-1}$ | 0.25 |
| $H_2$/HC ratio, $feet^3$/bbl | 5,000 |

The catalyst employed in Example 1 and all other examples of the present invention, has the properties shown in Table 3.

TABLE 3

Properties of the catalyst, used in all examples of the present invention.

| Property | Value |
|---|---|
| Molybdenum, weight % | 2.2 |
| Nickel, weight % | 0.6 |
| Specific surface area, $m^2/g$ | 199 |
| Total pore volume, $m^2/g$ | 0.85 |
| Compact density, g/ml | 0.584 |
| Particle diameter, mm | 1.15 |

The catalytically hydrotreated product was subjected to Step 3) Separation of partially upgraded oil, of the present invention. The properties of the final product are reported in Table 4.

From Table 4 it is important to note the considerable decrease in kinematic viscosity at 37.8° C. of heavy crude oil from 4623 cSt (Table 1) to 230.2 cSt in the partially upgraded oil (Table 4), which ensures compliance with the specification for transportation, which is equal to or less than 250 cSt measured at 37.8° C. The API gravity of heavy crude oil increased 4.68 degrees (from 12.7 to 17.38° API) helping the crude oil achieve better quality for transportation. The operating conditions of this processing allow for low sulfur removal from 5.25 weight % to 3.243 weight %. Low metal (Ni+V) removal is also obtained from a value of 541.82 ppm to 348.47 ppm. The sediment content shows low values of 0.012 weight %.

TABLE 4

Properties of the partially upgraded oil (Example 1).

| Properties | Value |
|---|---|
| Specific gravity 60/60° F. | 0.9504 |
| Specific weight 20/4° C. | 0.9476 |
| API Gravity | 17.38 |
| Kinematic viscosity, cSt @: | |
| 25.0° C. | 601.4 |
| 37.8° C. | 230.2 |
| 54.4° C. | 85.2 |
| TBP Distillation, ° C. | |
| IBP/5 vol % | 41/125 |
| 10/20 vol % | 176/262 |
| 30/40 vol % | 333/401 |
| 50/60 vol % | 470/536 |
| 70/80 vol % | —/— |
| Sulfur, weight % | 3.243 |
| Metals, wppm | |
| Nickel | 70.18 |
| Vanadium | 278.29 |
| Ni + V | 348.47 |
| Sediment content, weight % | 0.012 |
| Conversion, vol %. | 18.3 |

IBP: Initial Boiling Point;
TBP: True Boiling Point

Example 2

The desalted crude oil, obtained in step 1) of Example 1 was subjected to Step 2) catalytic hydrotreatment of heavy and/or extra-heavy desalted crude oil, process of the present invention, using a single fixed-bed reactor at operating conditions listed in Table 5.

TABLE 5

Operating conditions of step 2) Catalytic hydrotreating of the heavy and/or extra-heavy crude oil, of the present invention, (Example 2).

| Variable | Condition |
|---|---|
| Pressure, kg/cm$^2$ | 100 |
| Temperature, ° C. | 380 |
| Space velocity (LHSV) | 0.25 |
| $H_2$/HC ratio, feet$^3$/bbl | 5,000 |

The catalytically hydrotreated product, was subjected to Step 3) Separation of partially upgraded crude, of the present invention, obtaining the final product whose properties are reported in Table 6.

From Table 6, it is important to notice the significant decrease in kinematic viscosity at 37.8° C. of heavy crude oil, from 4,623 cSt (Table 1) to 151.0 cSt in the partially upgraded oil (Table 6), which far exceeds compliance with the specification for transportation; that is, a value equal to or less than 250 cSt measured at 37.8° C. The API gravity of heavy crude oil increased 8.02 degrees, from 12.7 to 20.72° API, helping substantially improve their quality for transport. The sulfur removal was carried out from 5.25 weight % to 1.95 weight %, which corresponds to a low removal level for this impurity. Metal removal obtained was from a value of 541.82 ppm Ni+V to a value of 185.9 ppm Ni+V. Finally, the sediment content displayed low values of 0011% wt.

TABLE 6

Properties of partially upgraded oil (Example 2).

| Properties | Value |
|---|---|
| Specific gravity 60/60° F. | 0.9296 |
| Specific weight 20/4 ° C. | 0.9268 |
| API Gravity | 20.72 |
| Kinematic viscosity, cSt @: | |
| 37.8° C. | 151.0 |
| TBP Distillation, ° C. | |
| IBP/5 vol % | 77/153.6 |
| 10/20 vol % | 201.6/272.0 |
| 30/40 vol % | 326.9/381.9 |
| 50/60 vol % | 435.1/498.6 |
| 70/80 vol % | 559.8/607.1 |
| 90/95 vol % | 656.1/684.5 |
| FBP | 712.2 |
| Sulfur, weight % | 1.95 |
| Metals, wppm | |
| Nickel | 34.7 |
| Vanadium | 151.2 |
| Ni + V | 185.9 |
| Sediment content, weight % | 0.011 |
| Conversion, vol %. | 24.39 |

IBP: Initial Boiling Point;
FBP: Final Boiling Point
TBP: True Boiling Point

Example 3

The catalytically hydrotreated product obtained from step 1) of Example 1, was also subjected to Step 2) Catalytic hydrotreating of heavy and/or extra-heavy desalted crude oil, of the present invention, using a single fixed-reactor at operating conditions given in Table 7.

TABLE 7

Operating conditions of step 2) Catalytic hydrotreating heavy and/or extra-heavy desalted crude oil, of the present invention, of Example 3.

| Variable | Condition |
|---|---|
| Pressure, kg/cm$^2$ | 100 |
| Temperature, ° C. | 390 |
| Space velocity (LHSV), h$^{-1}$ | 0.5 |
| $H_2$/HC ratio, feet$^3$/bbl | 5,000 |

The catalytically hydrotreated product was subjected to Step 3) Separation of partially upgraded oil, of the present invention, obtaining the final product whose properties are reported in Table 8.

From Table 8 it is observed a decrease in the kinematic viscosity at 37.8° C. of heavy crude oil from 4623 cSt (Table 1) to 235.5 cSt in the partially upgraded product (Table 8), which also achieves the specification for its transportation, that is equal to or less than 250 cSt measured at 37.8° C. The API gravity of heavy crude oil increased 6.36 degrees, from 12.7 to 19.06° API, which improves the quality for its transportation. The sulfur removal in this case was from 5.25 weight % to 2.38 weight % which corresponds to a low level conversion of this impurity. Metal removal is obtained from 541.82 ppm Ni+V to 267.9 ppm. The sediment content offered low values of 0.009 weight %.

TABLE 8

Properties of partially upgraded oil (Example 3).

| Properties | Value |
|---|---|
| Specific gravity 60/60° F. | 0.9398 |
| Specific weight 20/4° C. | 0.9370 |
| API Gravity | 19.06 |
| Kinematic viscosity, cSt @: | |
| 37.8° C. | 235.5 |
| TBP Distillation, ° C. | |
| IBP/5 vol % | 75.3/149.5 |
| 10/20 vol % | 207.6/288.9 |
| 30/40 vol % | 348.4/403.9 |
| 50/60 vol % | 458.1/520.3 |
| 70/80 vol % | 578.8/629.0 |
| 90/95 vol % | 673.1/694.2 |
| FBP | 716.2 |
| Sulfur, weight % | 2.38 |
| Metals, wppm | |
| Nickel | 56.1 |
| Vanadium | 211.8 |
| Ni + V | 267.9 |
| Sediment content, weight % | 0.009 |
| Conversion, vol %. | 18.53 |

IBP: Initial Boiling Point;
FBP: Final Boiling Point;
TBP: True Boiling Point

Example 4

The desalted crude oil obtained from step 1) of Example 1, was further subjected to Step 2) Catalytic hydrotreating of heavy and/or extra-heavy crude oil, of the present invention, using a single fixed-bed reactor at operating conditions shown on Table 9.

TABLE 9

Operating conditions of step 2) Catalytic hydrotreating of heavy and/or extra-heavy desalted crude oil, of the present invention, obtained in step 1 (Example 4).

| Variable | Condition |
|---|---|
| Pressure, kg/cm$^2$ | 70 |
| Temperature, ° C. | 380 |
| Space velocity (LHSV), h$^{-1}$ | 0.25 |
| $H_2$/HC ratio, feet$^3$/bbl | 5,000 |

The catalytically hydrotreated product was subjected to Step 3) Separation of partially upgraded oil, of the present invention, obtaining the final product whose properties are detailed in Table 10.

From Table 10 it is seen that the kinematic viscosity at 37.8° C. of heavy crude oil decreases from 4623 cSt (Table 1) to 192.0 cSt in the partially upgraded product (Table 10), which surpasses 250 cSt at 37.8° C., the specification for its transportation. The API gravity of heavy crude oil increased 6.59 degrees, from 12.7 to 19.29° API, contributing to improve the quality for its transportation. The sulfur content was reduced from 5.25 weight % to 2.22 weight %, maintaining a low level remotion for this impurity. Low metal removal is obtained from 541.82 ppm Ni+V to 245.5 ppm. The sediment content offered low values of 0.009 weight %.

TABLE 10

Properties of partially upgraded oil (Example 4).

| Properties | Value |
|---|---|
| Specific gravity 60/60° F. | 0.9384 |
| Specific weight 20/4° C. | 0.9356 |
| API Gravity | 19.29 |
| Kinematic viscosity, cSt @: | |
| 37.8° C. | 192.0 |
| TBP Distillation, ° C. | |
| IBP/5 vol % | 68.1/90.9 |
| 10/20 vol % | 159.8/246.1 |
| 30/40 vol % | 306.6/363.9 |
| 50/60 vol % | 419.3/484.4 |
| 70/80 vol % | 550.2/600.0 |
| 90/95 vol % | 652.0/682.6 |
| FBP | 712.6 |
| Sulfur, weight % | 2.22 |
| Metals, wppm | |
| Nickel | 48.27 |
| Vanadium | 197.25 |
| Ni + V | 245.5 |
| Sediment content, weight % | 0.009 |
| Conversion, vol %. | 19.40 |

IBP: Initial Boiling Point;
FBP: Final Boiling Point;
TBP: True Boiling Point

Example 5

The desalted heavy crude oil of Example 1 was subjected to step 2) Catalytic hydrotreating of heavy and/or extra-heavy desalted crude oil, of the present invention, using a single fixed-bed reactor at operating conditions given in Table 11.

TABLE 11

Operating conditions of step 2) Catalytic hydrotreating of heavy and/or extra-heavy desalted crude oil, of the present invention, (Example 5).

| Variable | Condition |
|---|---|
| Pressure, kg/cm$^2$ | 50 |
| Temperature, ° C. | 390 |
| Space velocity (LHSV), h$^{-1}$ | 0.25 |
| $H_2$/HC ratio, feet$^3$/bbl | 5,000 |

The catalytically hydrotreated product was subjected to Step 3) Separation of partially upgraded oil of the present invention, obtaining the final product whose properties are reported in Table 12.

The kinematic viscosity at 37.8° C. of heavy crude oil is reduced from 4623 cSt (Table 1) to 173.5 cSt in the partially upgraded product (Table 12), which also achieves the specification for its transportation, that is equal to or less than 250 cSt measured at 37.8° C. The API gravity of heavy crude oil increased 5.95 degrees from 12.7 to 18.65° API. The sulfur removal was from 5.25 weight % to 2.84 weight %. Metal removal is obtained from 541.82 ppm to 291.8 ppm Ni+V. The sediment content presented low values of 0.029 weight %.

TABLE 12

Properties of partially upgraded oil (Example 5).

| Properties | Value |
|---|---|
| Specific gravity 60/60° F. | 0.9424 |
| Specific weight 20/4° C. | 0.9396 |
| API Gravity | 18.65 |
| Kinematic viscosity, cSt @: | |
| 37.8° C. | 173.3 |
| TBP Distillation, ° C. | |
| IBP/5 vol % | 97.2/173.3 |
| 10/20 vol % | 228.1/293.1 |
| 30/40 vol % | 346.4/398.2 |
| 50/60 vol % | 448.7/506.7 |
| 70/80 vol % | 567.3/625.3 |
| 90/95 vol % | 672.0/693.6 |
| FBP | 716.5 |
| Sulfur, weight % | 2.84 |
| Metals, wppm | |
| Nickel | 59.8 |
| Vanadium | 232.0 |
| Ni + V | 291.8 |
| Sediment content, weight % | 0.029 |
| Conversion, vol %. | 24.15 |

IBP: Initial Boiling Point;
FBP: Final Boiling Point;
TBP: True Boiling Point

Example 6

The desalted crude oil obtained from step 1) of Example 1, was further subjected to Step 2) Catalytic hydrotreating of heavy and/or extra-heavy desalted crude oil of the present invention, using a single fixed reactor at operating conditions shown on Table 13.

TABLE 13

Operating conditions of step 2) Catalytic hydrotreating of the heavy and/or extra-heavy desalted crude oil, (Example 6).

| Variable | Condition |
|---|---|
| Pressure, kg/cm$^2$ | 50 |
| Temperature, ° C. | 400 |
| Space velocity (LHSV), h$^{-1}$ | 0.5 |
| $H_2$/HC ratio, feet$^3$/bbl | 5,000 |

The catalytically hydrotreated product was subjected to Step 3) Separation of upgraded oil for its transportation of the present invention, obtaining the final product whose properties are shown in Table 14.

From Table 14 it is important to remark the decrease in the kinematic viscosity at 37.8° C. of heavy crude oil from 4623 cSt (Table 1) to 221.1 cSt in the partially upgraded product (Table 11), which also achieves the specification for its transportation, that is equal to or less than 250 cSt measured at 37.8° C. The API gravity of heavy crude oil increased 4.61 degrees from 12.7 to 17.31° API. The sulfur removal was from 5.25 weight % to 3.5 weight %. Low metal (Ni+V) removal is obtained from 541.82 ppm to 417.1 ppm. Finally, the corresponding sediment content was 0.036 weight %.

TABLE 14

Properties of partially upgraded oil (Example 6).

| Properties | Value |
|---|---|
| Specific gravity 60/60° F. | 0.9509 |
| Specific weight 20/4° C. | 0.9481 |
| API Gravity | 17.31 |
| Kinematic viscosity, cSt @: | |
| 37.8° C. | 221.1 |
| TBP Distillation, ° C. | |
| IBP/5 vol % | 94.9/169.7 |
| 10/20 vol % | 220.2/292.6 |
| 30/40 vol % | 350.6/407.4 |
| 50/60 vol % | 462.5/519.4 |
| 70/80 vol % | 567.7/616.2 |
| 90/95 vol % | 666.4/691.0 |
| FBP | 715.7 |
| Sulfur, weight % | 3.50 |
| Metals, wppm | |
| Nickel | 75.9 |
| Vanadium | 341.2 |
| Ni + V | 417.1 |
| Sediment content, weight % | 0.036 |
| Conversion, vol %. | 21.95 |

IBP: Initial Boiling Point;
FBP: Final Boiling Point;
TBP: True Boiling Point

From the results of the tables of the above examples it is important to highlight the significant decrease in kinematic viscosity at 37.8° C. of heavy crude oil from 4623 cSt (Table 1) to values in the partially upgraded oil that achieve the specification for transportation, that is equal to or less than 250 cSt at 37.8° C. The API gravity of heavy crude oil shows increments of 4.61-8.02 degrees making the crude oil to have better quality for transportation. The operating conditions of the process of this invention allow for sulfur removal from 5.25 weight % to 1.95 weight %, which does not produce excessive amount of hydrogen sulfide and hence does not require additional equipment for the treating of sour gas. The low metal removal (Ni+V) is performed from 541.82 ppm to 185.9 ppm, with these data and considering the hydrocarbon mass entering and leaving the reactor, a mass balance is performed to estimate the amount of metals deposited on the catalyst surface by means of difference, which is divided by the amount of catalyst loaded to the reactor, and thereby the rate of metal deposition on the catalyst is determined.

The metal deposition rate on the catalyst is calculated by dividing the percentage of metal deposit (weight %) over the accumulated time-on-stream in hours to obtain a deposition rate, which was found to be 0.0168 weight % per hour. This deposition rate allows to calculate the lifetime of the catalyst by dividing the maximum metal retention capacity of the catalyst (120 weight % for this catalyst) over the metal deposition rate (in weight %/h), resulting in 10 months approximately.

The metal deposition rate is not influenced by the change of operating conditions so this value is the same for all examples of the present invention.

In addition, the sediment content shows low levels lower than 0.04 weight %, allowing the process to be maintained for long operating cycles.

What is claimed is:

1. A process for partial upgrading of properties of heavy and/or extra-heavy crude oils, by catalytic hydrotreatment, which comprises the following steps:

1) desalting of the heavy or extra-heavy crude oil;

2) catalytic hydrotreating of the heavy and/or extra-heavy desalted crude oil at maximum temperatures of 400° C. and 100 kg/cm$^2$ of pressure or less in a single reaction step to obtain a partially upgraded crude oil, wherein the catalytic hydrotreating step includes a catalyst having a metal loading of molybdenum from 2 to 8 weight % and nickel or cobalt from 0.1 to 3 weight % in the catalyst, supported on gamma alumina, with a surface area of 180 to 200 m$^2$/g, pore volume of 0.7 to 0.8 cm$^3$/g, and having a shape profile selected from the group consisting of cylindrical extrudates, lobular and spheres with a diameter of 1 to 3 mm; and 3) separation of partially upgraded oil;

wherein said heavy and/or extra heavy crude oils have an API gravity of 3-16 units, and said partially upgraded oil has a kinematic viscosity equal to or less than 250 cSt at 37.8° C., and API gravity increase of 4 to 8 degrees and where said upgraded oil has better quality for its transportation from platforms to maritime terminals or to refining centers.

2. The process according to claim 1, wherein the desalters employed in step 1) are of the dielectric type, for crude oil containing less than 200 pounds salt per 1,000 barrels.

3. The process according to claim 1, wherein step 1) is carried out under pressure of 7 to 14 kg/cm$^2$ and temperature of 125 to 150° C.

4. The process according to claim 1, wherein in step 1) the pressure value is preferably at least 2 kg/cm$^2$ above the vapor pressure of a crude oil-water mixture at the operating temperature.

5. The process according to claim 1, wherein the catalytic hydrotreatment of crude oil in step 2) is performed in a fixed bed reactor with a catalyst containing metals selected from the group consisting of Pt, Pd, Ni, Mo and Co.

6. The process of claim 1, wherein the catalytic hydrotreatment is carried out in a fixed bed reactor with a catalyst selected from the group consisting of Ni, Mo and Co, nickel-molybdenum (Ni—Mo) mixtures and cobalt-molybdenum (Co—Mo) mixtures supported on a support selected from aluminum oxide (alumina), silicon, titanium and mixtures thereof, wherein said aluminum oxide is in the gamma alumina phase.

7. The process according to claim 1, wherein the catalytic hydrotreatment of crude oil in step 2) in addition to the catalyst bed materials further includes pressure drop relaxers, with or without catalytic activity of hydrogenation, hydrocracking, or both, with shapes selected from the group consisting of spheres, tablets, and raschig rings.

8. The process according to claim 1, wherein step 2) is carried out at pressure of 40 to 100 kg/cm$^2$, hydrogen-to-hydrocarbon ratio of 2,000 to 5,000 ft$^3$/bbl, temperature of 360 to 400° C. and space velocity or volumetric flow relative to the volume of catalyst (LHSV: liquid hourly space velocity) of 0.25 to 3 h$^{-1}$.

9. The process according to claim 1, wherein the separation of the partially upgraded oil in step 3) comprises the step of removing sour gases produced in the hydrotreatment from the partially upgraded oil.

10. The process according to claim 9, wherein up to 63% of sulfur is removed from the partially upgraded oil.

11. The process according to claim 1, wherein up to 66% of the metal (Ni+V) is removed with a global deposit rate equal to 0.0168 weight % per hour, equivalent to a catalyst life of 10 months.

12. The process according to claim 1, wherein the partially upgraded oil has a sediment content is less than 0.04 weight %.

13. A method of transporting heavy and/or extra heavy crude oil including the steps of hydrotreating heavy and/or extra heavy crude oil at a temperature of not higher than 400° C. and pressure of 100 kg/cm$^2$ or less in a single reaction step to increase the API about 4 to 8 degrees, recovering the partially upgraded crude oil, wherein said recovering step comprises feeding said partially upgraded crude oil from the hydrotreating step to a separator to obtain a gas stream and a liquid stream, separating a hydrocarbon liquid condensate from said gas stream, and combining said hydrocarbon liquid condensate with said liquid stream to obtain said partially upgraded crude oil, and transporting the crude oil through a pipeline.

14. The method of claim 13, wherein said desalting step is carried out under a pressure of 7 to 14 kg/cm$^2$ and a temperature of 125° C. to 150° C.

15. The method of claim 1, wherein said separation step comprises feeding said partially upgraded crude oil from the hydrotreating step to a separator to obtain a gas stream and a liquid stream, separating a hydrocarbon liquid condensate from said gas stream, and combining said hydrocarbon liquid condensate with said liquid stream to obtain said partially upgraded crude oil.

16. A process for partially upgrading a heavy and/or extra-heavy crude oil comprising the steps of:

1) desalting a heavy or extra-heavy crude oil feed by passing the crude oil feed through two desalters connected in series to obtain a desalted crude oil;

2) catalytic hydrotreating the desalted heavy and/or extra-heavy crude oil in the presence of a catalyst at a maximum temperature of 400° C. and a pressure of 100 kg/cm$^2$ or less in a single reaction step to obtain the partially upgraded crude oil, wherein said catalyst has a molybdenum content of 2 to 8 weight % and nickel or cobalt content of 0.1 to 3 weight % in the catalyst, supported on gamma alumina, with a surface area of 180 to 200 m$^2$/g, a pore volume of 0.7 to 0.8 cm$^3$/g, and having a shape profile selected from the group consisting of cylindrical extrudates, lobular and spheres with a diameter of 1 to 3 mm; and 3) separating said partially upgraded crude oil from the resulting reaction mixture of the hydrotreating step;

wherein said heavy and/or extra heavy crude oil has an API gravity of 3-16 units, and said partially upgraded crude oil has a kinematic viscosity equal to or less than 250 cSt at 37.8° C., and API gravity increase of 4 to 8 degrees with respect to said heavy and/or extra heavy crude oil feed.

17. The method of claim 16, wherein said separating step comprises feeding said partially upgraded crude oil from the hydrotreating step to a separator to obtain a gas stream and a liquid stream, separating a hydrocarbon liquid condensate from said gas stream, and combining said hydrocarbon liquid condensate with said liquid stream to obtain said partially upgraded crude oil.

* * * * *